US006819239B2

(12) United States Patent
Bingham

(10) Patent No.: US 6,819,239 B2
(45) Date of Patent: Nov. 16, 2004

(54) LIGHTING SECURITY SYSTEM

(76) Inventor: Victoria J. Bingham, 6442 Overlook Dr., Alexandria, VA (US) 22312

( * ) Notice: Subject to any disclaimer, the term of this patent is extended or adjusted under 35 U.S.C. 154(b) by 163 days.

(21) Appl. No.: 10/223,602

(22) Filed: Aug. 20, 2002

(65) Prior Publication Data

US 2004/0036603 A1 Feb. 26, 2004

(51) Int. Cl.[7] ..... G08B 13/00
(52) U.S. Cl. ..... 340/541; 340/552; 340/567
(58) Field of Search ..... 340/541, 552–557, 340/565–567, 531; 398/173

(56) References Cited

U.S. PATENT DOCUMENTS

| | | | | |
|---|---|---|---|---|
| 3,988,570 A | | 10/1976 | Murphy et al. | 235/382 |
| 4,081,669 A | | 3/1978 | Klingman, III | 356/139.04 |
| 4,262,284 A | | 4/1981 | Stieff et al. | 340/541 |
| 4,401,976 A | | 8/1983 | Stadelmayr | 340/522 |
| 4,622,538 A | | 11/1986 | Whynacht et al. | 340/506 |
| 4,629,941 A | * | 12/1986 | Ellis et al. | 315/153 |
| 4,652,202 A | | 3/1987 | Kersten | 414/648 |
| 4,766,419 A | | 8/1988 | Hayward | 340/545.2 |
| 4,772,875 A | | 9/1988 | Maddox et al. | 340/522 |
| 4,812,994 A | | 3/1989 | Taylor et al. | 340/5.28 X |
| 4,833,455 A | | 5/1989 | Bishop | 340/568.1 |
| 4,857,912 A | | 8/1989 | Everett, Jr. et al. | 340/508 |
| 4,864,278 A | * | 9/1989 | Wiley | 340/555 |
| 4,944,008 A | | 7/1990 | Piosenka et al. | 380/46 |
| 5,053,748 A | | 10/1991 | Stern | 340/541 |
| 5,155,474 A | | 10/1992 | Park et al. | 340/691.5 |
| 5,495,288 A | | 2/1996 | Broady et al. | 348/155 |
| 5,563,579 A | | 10/1996 | Carter | 340/539.17 |
| 5,689,243 A | | 11/1997 | Bianco | 340/5.26 |
| 5,781,108 A | * | 7/1998 | Jacob et al. | 340/552 |
| 5,819,124 A | | 10/1998 | Somner et al. | 396/263 |
| 5,890,797 A | * | 4/1999 | Bish | 362/419 |
| 6,309,090 B1 | * | 10/2001 | Tukin | 362/276 |

FOREIGN PATENT DOCUMENTS

| | | |
|---|---|---|
| FR | 2 573 893 | 5/1986 |
| GB | 2 282 231 A | 3/1995 |
| GB | 2 293 247 A | 3/1996 |
| WO | WO 93/07233 | 4/1993 |

* cited by examiner

*Primary Examiner*—Thomas J Mullen, Jr.
(74) *Attorney, Agent, or Firm*—Richard C. Litman

(57) ABSTRACT

A lighting security system includes a plurality of light packs. Each light pack includes at least two light sources, a plurality of motion sensors, an imaging unit, an electric eye, a lens, a processing element, a timer, and a power source. Upon detection of movement of an object in a designated area of a light pack, each light of the light pack activates and successively activates the other light packs of the plurality of light packs until all of the light packs are activated. Each light pack may also include one or more switches, an audible indicator, a modem configured to wirelessly or non-wirelessly transfer data to/from the light pack. If a light pack is configured for wireless data transfer, the light pack will also include a transceiver and an antenna.

36 Claims, 6 Drawing Sheets

LIGHTING SECURITY SYSTEM

BACKGROUND OF THE INVENTION

1. Field of the Invention

The present invention relates generally to security systems, and more particularly to security systems that economically integrate a new variety of known technologies and security techniques.

2. Description of the Related Art

Security systems presently exist that monitor residential and business properties, and activate deterrent devices, such as lights, alarms, etc., upon detecting disturbances, particularly near entryways to homes or buildings between dusk and dawn. Such security systems employ a variety of sensors such as passive infrared (PIR) motion detectors, mechanical switches, pressure pads, etc. to trigger the deterrent devices. Security systems also exist that employ video cameras to record particular areas. These video cameras are either configured to continuously record the area or to periodically capture a few seconds of time of the area. However, no security systems are presently available that economically integrate a variety of available technologies and security techniques.

The related art is represented by the following references of interest.

U.S. Pat. No. 3,988,570, issued on Oct. 26, 1976 to Arthur J. Murphy et al., describes a system for controlling access to a secure area under surveillance by a single ticket seller. Murphy et al. does not suggest a lighting security system according to the claimed invention.

U.S. Pat. No. 4,081,669, issued on Mar. 28, 1978 to Edwin E. Klingman, III, describes a system for controlling access to a secure area under surveillance by a single ticket seller. Klingman, III does not suggest a lighting security system according to the claimed invention.

U.S. Pat. No. 4,262,284, issued on Apr. 14, 1981 to Lorin R. Stieff et al., describes a self-monitoring seal having a container, a communication fiber optic loop means extending from the container, and a monitor mounted in the container adjacent the communication loop. Stieff et al. does not suggest a lighting security system according to the claimed invention.

U.S. Pat. No. 4,401,976, issued on Aug. 30, 1983 to Hans-Günther Stadelmayr, describes an alarm, safeguarding and monitoring system for a room zone including a plurality of sensors disposed at different positions and responsive to different physical phenomena. Stadelmayr does not suggest a lighting security system according to the claimed invention.

U.S. Pat. No. 4,622,538, issued on Nov. 11, 1986 to Charles Whynacht et al., describes a plurality of different types of operating systems in buildings organized in geographical groups, each group having a local service office, that are monitored at both local offices and a central office for the presence of performance conditions and conditions indicative of an alarm condition. Whynacht et al. does not suggest a lighting security system according to the claimed invention.

U.S. Pat. No. 4,652,202, issued on Mar. 24, 1987 to Donald J. Kernsten, describes a lift mechanism for use on the input and output sides of machines for processing sheets of particle board, plywood and similar products. Kernsten does not suggest a lighting security system according to the claimed invention.

U.S. Pat. No. 4,766,419, issued on Aug. 23, 1988 to Gilbert O. Hayward, describes an apparatus for recording the opening or closing of a closure member. Hayward does not suggest a lighting security system according to the claimed invention.

U.S. Pat. No. 4,771,875, issued on Sep. 20, 1988 to James F. Maddox et al., describes an intrusion detector including a first sensor for monitoring a first condition and a second sensor for monitoring a second condition in a space to be protected against intrusion. Maddox et al. does not suggest a lighting security system according to the claimed invention.

U.S. Pat. No. 4,812,994, issued on Mar. 14, 1989 to Michael P. Taylor et al., describes a postage metering lock-out security system. Taylor et al. does not suggest a lighting security system according to the claimed invention.

U.S. Pat. No. 4,833,455, issued on May 23, 1989 to Roy G. Bishop, describes an anti-tampering device for utility meters. Bishop does not suggest a lighting security system according to the claimed invention.

U.S. Pat. No. 4,857,912, issued on Aug. 15, 1989 to Hobart R. Everett, Jr. et al., describes an intelligent security assessment system. Everett, Jr. et al. does not suggest a lighting security system according to the claimed invention.

U.S. Pat. No. 4,944,008, issued on Jul. 24, 1990 to Gerald V. Piosenka et al., describes a data locking system. Piosenka et al. does not suggest a lighting security system according to the claimed invention.

U.S. Pat. No. 5,155,474, issued on Oct. 13, 1992 to Roy G. Park et al., describes a photographic security system for detecting the presence of an intruder in a forbidden space. Park et al. does not suggest a lighting security system according to the claimed invention.

U.S. Pat. No. 5,495,288, issued on Feb. 27, 1996 to George K. Broady et al., describes a surveillance system having a monitor, a camera connected to the monitor by a camera cable, an event recorder connected to the monitor by a recorder cable, and an activation unit connected to the camera by an activation unit cable. Broady et al. does not suggest a lighting security system according to the claimed invention.

U.S. Pat. No. 5,563,579, issued on Oct. 8, 1996 to Ronald L. Carter, describes a security key control information system for vehicle dealerships and the like. Carter does not suggest a lighting security system according to the claimed invention.

U.S. Pat. No. 5,689,243, issued on Nov. 18, 1997 to Mark E. Bianco, describes a system and method that provides an electronic indication that unauthorized access has been gained to a system. Bianco does not suggest a lighting security system according to the claimed invention.

U.S. Pat. No. 5,819,124, issued on Oct. 6, 1998 to Timothy L. Somner et al., describes a security system including a camera connected to a motion sensor for detecting motion in the vicinity of the camera. Somner et al. does not suggest a lighting security system according to the claimed invention.

France Patent document 2 573 893, published on May 30, 1986, describes a method and devices for triggering an alarm or an automatic unit while avoiding untimely triggering. France '893 does not suggest a lighting security system according to the claimed invention.

Great Britain Patent document 2 281 231 A, published on Mar. 29, 1995, describes a security apparatus including a camera, detector means for detecting the presence of an intruder, and switch means for causing operation of the camera consequent upon the detector means detecting the presence of the intruder. Great Britain '231 does not suggest a lighting security system according to the claimed invention.

Great Britain Patent document 2 293 247 A, published on Mar. 20, 1996, describes a security system including a camera connected to a motion sensor for detecting motion in vicinity of the camera, the system having a stand-by state in which the motion sensor is active wherein triggering of the motion sensor causes the camera to capture an image. Great Britain '247 does not suggest a lighting security system according to the claimed invention.

International Patent document WO 93/07233, published on Apr. 15, 1993, describes a composition for preventing unauthorized removal or damage to articles or goods from vehicles, buildings and/or premises or for preventing damage to premises. International '233 does not suggest a lighting security system according to the claimed invention.

None of the above inventions and patents, taken either singularly or in combination, is seen to describe the instant invention as claimed.

SUMMARY OF THE INVENTION

The present invention is a lighting security system. The lighting security system includes a plurality of light packs. Each light pack includes at least two light sources, a plurality of motion sensors, an imaging unit, an electric eye, a lens, a processing element, a timer, and a power source. Each light pack may also include one or more switches, an audible indicator, a modem configured to wirelessly or non-wirelessly transfer data to/from the light pack. If a light pack is configured for wireless data transfer, the light pack will also include a transceiver and an antenna.

Each light source is preferably a high powered light source, such as a halogen light or the like. Such a light source may have a wide angle light range, such as about 240° or the like, and may consume power in the range of about 300 to 700 watts, or the like. However, any known bright light source may be used according to the desires of the user.

Any known motion sensor may by utilized in the lighting security system. For example, each motion sensor may be PIR motion sensor. Such sensors have about a 120° arc and about a 50 foot range detection zone. However, motion sensors are known having a different arc or range detection zone, such as up to 500 feet. Known motion sensors also include those based on reflections of electromagnetic waves, light waves, and ultrasonic pressure, those based on the disturbance of static electric or magnetic fields, and those based on any other phenomenon whereby the motion of something within an area can be detected. Preferably, a plurality of motion sensors are employed, such as three or the like. The sensitivity of the selected motion sensor(s) may be adjusted in accordance with the desires of the user.

The imaging unit is preferably a digital camera that is configured to record digital image data in a data storage area. Such a camera includes an image sensor, such as a charge coupled device or the like, which converts photons into electrons, filters to provide color, and a removable recording device. Alternatively, the imaging unit may be a digital video camera configured to record digital video data in a data storage area. The lens for either a digital camera or a digital video camera is preferably a wide angle lens, such as 180° or more. The lens may have adjustable iris, focus, and zoom. The operation of digital cameras and digital video cameras are well known in the art.

The electric eye may be a photosensitive element that activates a light source in response to receiving a predetermined amount of light from a light source of another light pack or an independent light source. Incorporation of an electric eye into each light pack enables the light packs to be slaved to one another. For example, upon proper positioning and motion sensing, the light sources in one light pack may become active. One light source may be positioned for emitting light toward the area under monitor. The other light source may emit light toward the electric eye of another light pack. As such, a home equipped with a plurality of light packs positioned about the perimeter of the home may all become active after a single light pack becomes active. Alternatively, the light source of one light pack may emit light toward the area under monitor while the other light source may emit light toward a particular window of the home or a neighbor's home, etc., according to the desires of the user.

The processing element may include a control and memory. The control may be any known integrated control element, such as a central processing unit or the like. The memory may include random access memory (RAM), read only memory (ROM), and a data storage memory. ROM stores operational software code that is read and processed by the CPU, and that causes the CPU to perform programmed functions such as activating the lens, the lights, etc. The operational software code may cause the CPU to include the date, time of day, and location (e.g., street address or the like) of the lighting security system on the digital image or video recorded by the imaging unit. For example, if the imaging unit is a digital video camera the operational software code may cause the CPU to show the date, time of day, and location of the lighting security system on the bottom of the recorded video. The operational software code may also cause the CPU to automatically electronically transfer imaging data after recording, either wirelessly or non-wirelessly, to a desired location, e.g., a desired internet address, a security company, or the like. RAM temporarily stores data.

The timer is configured to activate the light sources and/or an audible indicator after detection of a disturbance in the area under monitor for a predetermined amount of time and to deactivate the light sources and/or audible indicator after the predetermined amount of time ends. The light pack may include switches to enable a user to easily perform a variety of functions, such as turning the light pack on or off, taking a picture, or the like.

The light pack may include one or more modems to transfer data to and from the light pack. Any known internal or external modem may be employed. Communications between the light pack and an external device, such as a personal computer or the like, occur over a universal asynchronous receiver transmitter link. A modem may be included in the light pack by inserting a modem card into a bus connector of the light pack for connecting to the light pack directly (an internal modem) or a modem may be connected to the light pack over a communication port, when the modem is external. Internal and external modems have an onboard processor or controller for managing the data protocols and transfers. As described above, each light pack of a lighting security system may include operational software code to automatically electronically transfer imaging data after recording, either wirelessly or non-wirelessly, to a desired location, e.g., a desired internet address, a security company, or the like. In addition, the light pack may include operational software to enable an authorized user to remotely reprogram the light pack wirelessly or non-wirelessly utilizing a security code, such as a personal identification number or the like.

The light pack may also include any known type of audible indicator, the sound level being adjustable according to the desires of the user. The light pack may be configured to activate such an audible indicator when disturbances occur in the area under monitor during times when the light pack is inactive, such as during daytime hours or the like. If the light pack is configured to transfer data non-wirelessly, the light pack includes an RJ-11 jack to permit interconnection of the light pack with a standard telephone line, and an RJ-11 jack to permit interconnection with an external computer.

The power source is preferably a rechargeable battery pack that is continuously charged by external 120 VAC utility power. Each light pack preferably includes a power cord with a connector to engage with an external utility power source. The use of a rechargeable battery pack prevents the light packs from being deactivated by cutting the power cord.

A method of effecting lighting security includes providing a plurality of light packs, each light pack having at least two light sources, a plurality of motion sensors, an imaging unit, an electric eye, a lens, a processing element, a timer, and a power source; positioning each light pack to monitor an associated designated area for movement of an object within the associated designated area; monitoring each designated area with the corresponding associated light pack for movement of an object in the associated designated area; activating each light of one light pack in predetermined directions upon detection of movement of an object in the designated area of the one light pack, one of the predetermined directions being toward another one of the plurality of light packs; successively activating each light of another light pack of the plurality of light packs until each light pack is activated; and recording at least one image of at least one designated area with at least one imaging unit of at least one light pack.

Accordingly, it is a principal aspect of the invention to provide a lighting security system including a plurality of light packs, each light pack including at least two light sources, a plurality of motion sensors, an imaging unit, an electric eye, a lens, a processing element, a timer, and a power source, wherein each light of one light pack of the plurality of light packs becomes active in a predetermined direction upon detection of movement of an object in the designated area of the one light pack, one of the predetermined directions being toward another one of the plurality of light packs, and each light pack of the plurality of light packs successively activates until each light pack of the plurality of light packs is activated.

It is another aspect of the invention to provide a lighting security system including a plurality of light packs, each light pack including at least two light sources, a plurality of motion sensors, a digital camera, an electric eye, a lens, a processing element, a timer, and a power source, wherein each light of one light pack of the plurality of light packs becomes active in predetermined directions upon detection of movement of an object in the designated area of the one light pack, one of the predetermined directions being toward another one of the plurality of light packs, and each of the other light packs of the plurality of light packs successively activates until each light pack of the plurality of light packs is activated.

It is a further aspect of the invention to provide a lighting security system including a plurality of light packs, wherein each light pack includes at least two light sources, a plurality of motion sensors, a digital video camera, an electric eye, a lens, a processing element, a timer, and a power source wherein each light of one light pack of the plurality of light packs becomes active in a predetermined direction upon detection of movement of an object in the designated area of the one light pack, one of the predetermined directions being toward another one of the plurality of light packs, and each light pack of the plurality of light packs successively activates until each light pack of the plurality of light packs is activated.

Still another aspect of the invention is to provide a lighting security system including a plurality of light packs, wherein each light pack includes at least two light sources, a plurality of motion sensors, a digital video camera, an electric eye, a lens, a processing element, a timer, at least one modem, a transceiver, an antenna, and a rechargeable battery pack wherein each light of one light pack of the plurality of light packs becomes active in a predetermined direction upon detection of movement of an object in the designated area of the one light pack, one of the predetermined directions being toward another one of the plurality of light packs, and each light pack of the plurality of light packs successively activates until each light pack of the plurality of light packs is activated.

Yet another aspect of the invention is to provide a method of effecting lighting security including providing a plurality of light packs, each light pack having at least two light sources, a plurality of motion sensors, an imaging unit, an electric eye, a lens, a processing element, a timer, and a power source; positioning each light pack to monitor an associated designated area for movement of an object within the associated designated area; monitoring each designated area with the corresponding associated light pack for movement of an object in the associated designated area; activating each light of one light pack in predetermined directions upon detection of movement of an object in the designated area of the one light pack, one of the predetermined directions being toward another one of the plurality of light packs; successively activating each light of another light pack of the plurality of light packs until each light pack is activated; and recording at least one image of at least one designated area with at least one imaging unit of at least one light pack.

It is an aspect of the invention to provide improved elements and arrangements thereof in a lighting security system for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
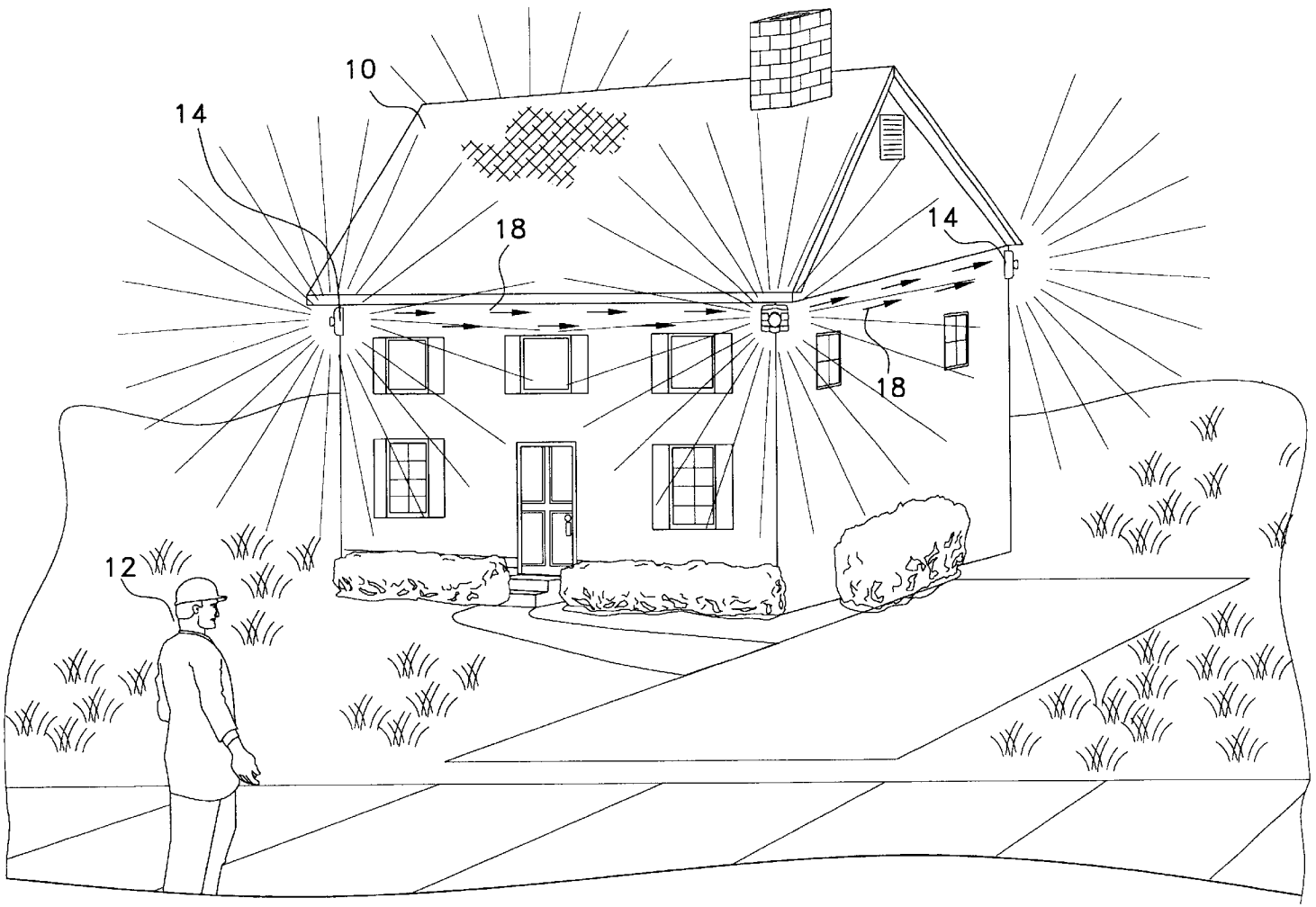
FIG. 1 is a front perspective view of a house equipped with a lighting security system according to the present invention.

The present invention is a lighting security system. The invention disclosed herein is, of course, susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

Figure 2:
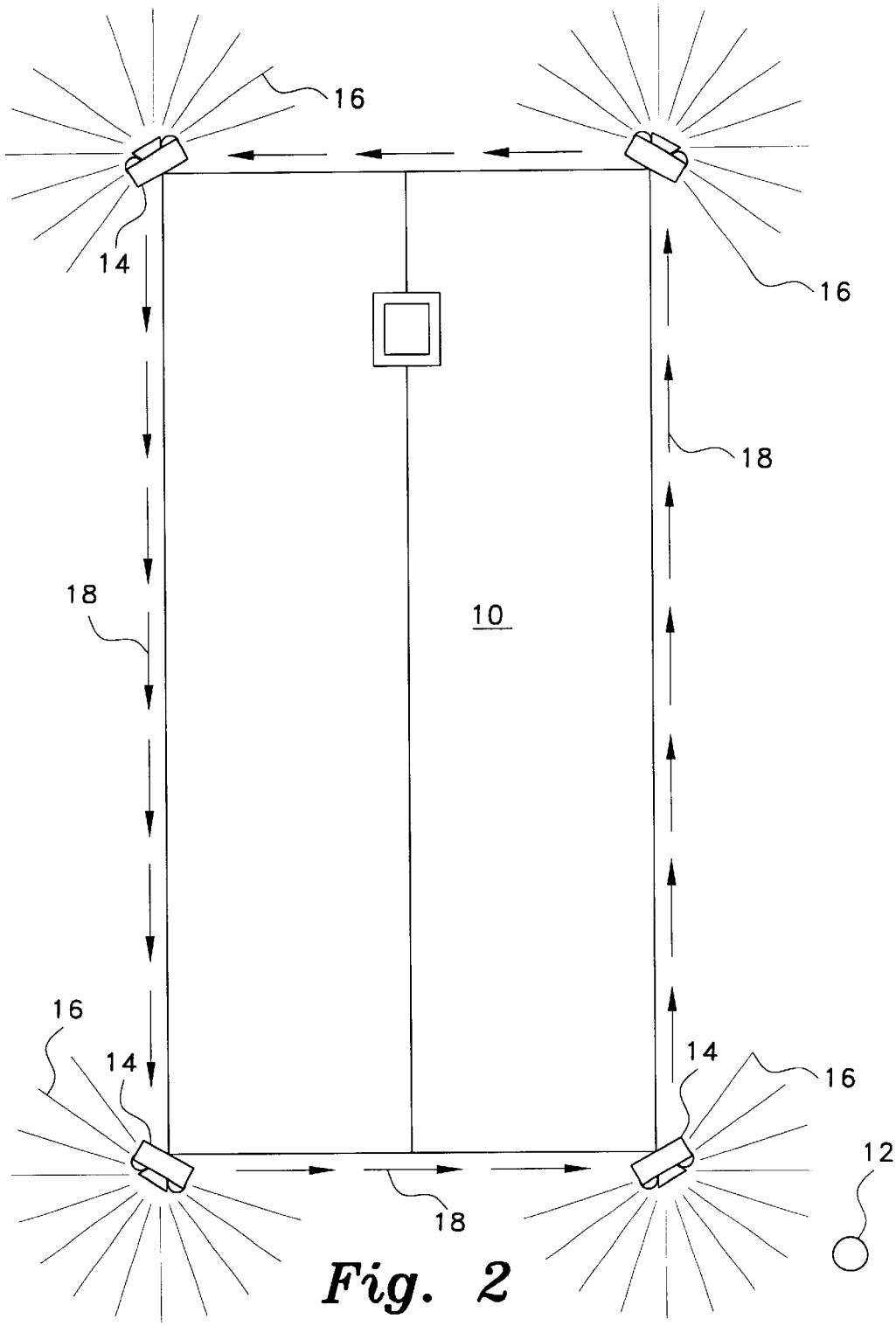
FIG. 2 is a top view of the house shown in FIG. 1.

Referring to the drawings, FIGS. 1 and 2 illustrate a residential home 10 equipped with a lighting security system according to the invention. In FIGS. 1 and 2, the lighting security system includes four light packs 14. Each light pack 14 includes a light source 16 which emits light upon detection of disturbance by an individual 12. Upon detection of the disturbance, the light pack 14 which detected the disturbance emits light directed 18 directed toward another light pack 14 within a brief period of time, such as microseconds or less. To the intruder 12, the lighting security system appears to activate simultaneously. Upon activation the light packs 14 may be recording and/or transmitting images of the scene in the areas associated with each light pack 14.

Figure 3:
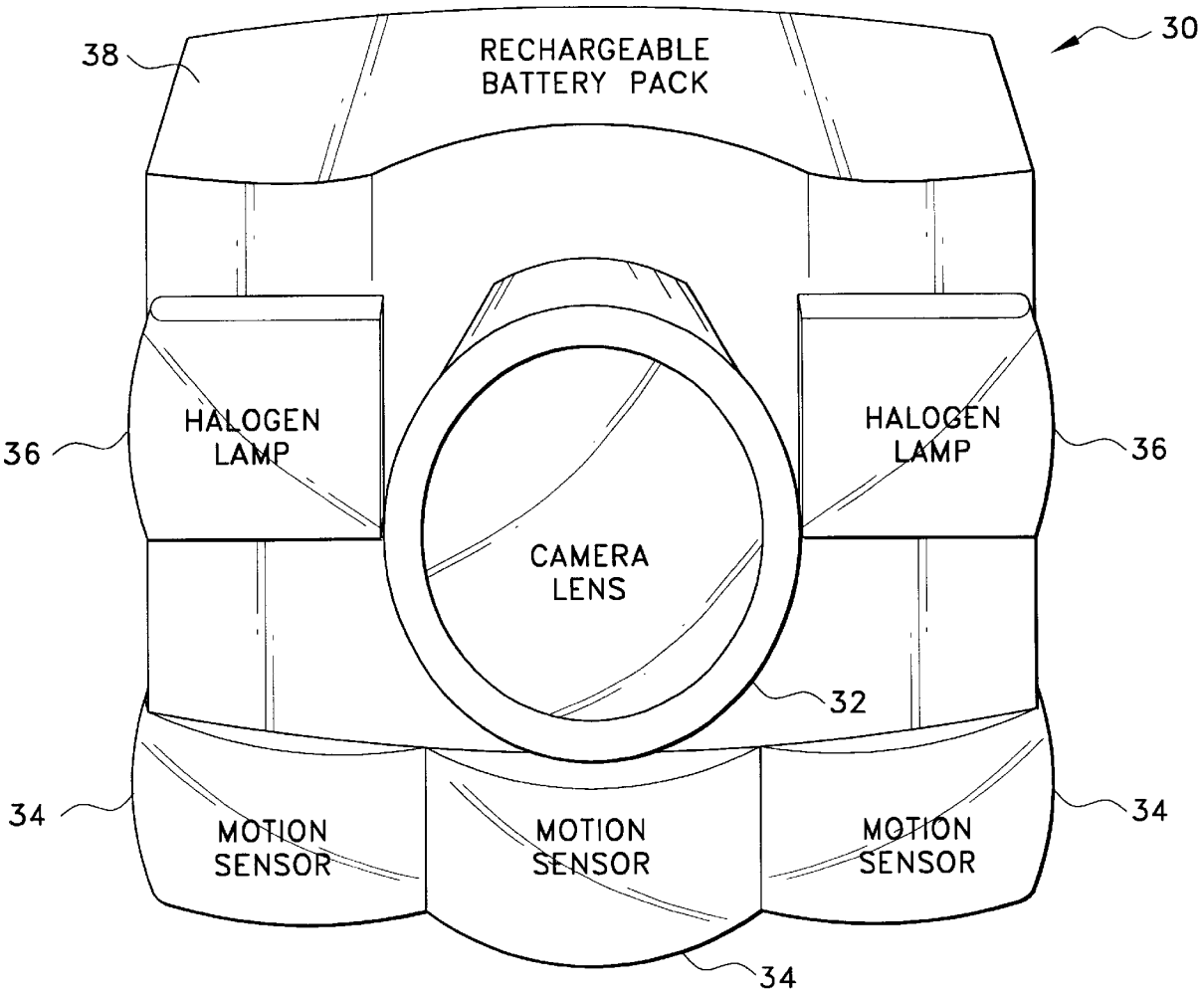
FIG. 3 is a front perspective view of an example of a camera/light source for a lighting security system according to the present invention.

FIG. 3 illustrates one example of a light pack 30 according to the invention. Light pack 30 is configured for use external to a business or residence. Light pack 30 includes two light sources 36, a plurality of motion sensors 34, an imaging unit (not shown), an electric eye (not shown), a lens 32, a processing element (not shown), a timer (not shown), and a power source 38. Light pack 30 may also include one or more switches (not shown), an audible indicator (not shown), and a modem (not shown) configured to wirelessly or non-wirelessly transfer data to/from light pack 30. If light pack 30 is configured for wireless data transfer, light pack 30 will also include a transceiver and an antenna.

In this example, each light source 36 is a halogen light. Such a halogen light preferably has a wide angle light range, such as about 240° or the like, and may consume power in the range of about 300 to 700 watts, or the like. However, any known bright light source may be used according to the desires of the user.

Any known motion sensor 34 may by utilized in light pack 30. For example, each motion sensor 34 may be PIR motion sensor. Such sensors have about a 120° arc and about a 50 foot range detection zone. However, motion sensors are known having a different arc or range detection zone, such as up to 500 feet. Known motion sensors also include those based on reflections of electromagnetic waves, light waves, and ultrasonic pressure, those based on the disturbance of static electric or magnetic fields, and those based on any other phenomenon whereby the motion of something within an area can be detected. In this example, three motion sensors 34 are employed. The sensitivity of the selected motion sensors may be adjusted in accordance with the desires of the user.

Figure 6:
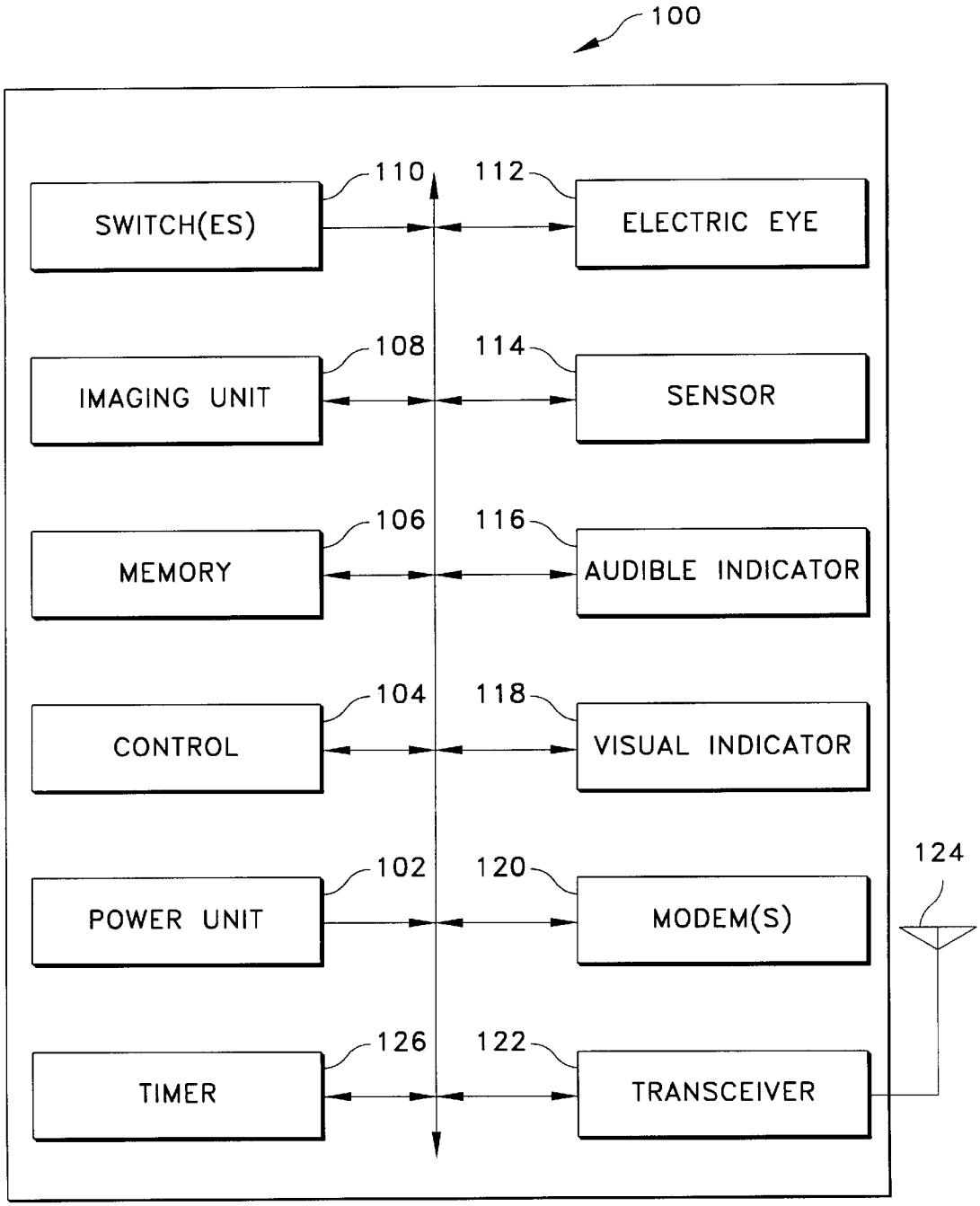
FIG. 6 is a block diagram of a lighting security system according to the invention.

The imaging unit 108, as seen in diagram 100 in FIG. 6, is preferably a digital camera that is configured to record digital image data in a data storage area. Such a camera includes an image sensor, such as a charge coupled device or the like, which converts photons into electrons, filters to provide color, and a removable recording device. Alternatively, imaging unit 108 may be a digital video camera that is configured to record digital video image data. The lens 32 for either a digital camera or a digital video camera is preferably a wide angle lens, such as 180° or more. The lens 32 may have adjustable iris, focus, and zoom. The operation of digital cameras and digital video cameras are well known in the art.

The electric eye 112 may be a photosensitive element that activates a light source in response to receiving a predetermined amount of light from a light source of another light pack or an independent light source (see FIG. 6 ). Incorporation of an electric eye 112 into light pack 30 enables light packs 30 to be slaved to one another. For example, upon proper positioning and motion sensing, halogen lights 36 in light pack 30 may become active. One halogen light 36 may be positioned for emitting light toward the area under monitor. The other halogen light 36 may emit light toward the electric eye of another light pack. As such, a home 10 equipped with a plurality of light packs 30 positioned about the pehmeter of the home 10 may all become active after a single light pack 30 becomes active. Alternatively, th one halogen light 36 of light pack 30 may emit light toward the area under monitor while the other halogen light 36 may emit light toward a particular window of the home or a neighbor's home, etc., according to the desires of the user.

The processing element may include a control 104 and memory 106 (see FIG. 6). Control 104 may be any known integrated control element, such as a central processing unit or the like. Memory 106 may include RAM, ROM, and a data storage memory. ROM stores operational software code that is read and processed by the CPU, and that causes the CPU to perform programmed functions such as activating the lens, the lights, etc. For example, light pack 30 may be programmed to be inactive during daytime hours and to become active during nighttime hours (such as becoming active at 9:00 pm or 10:00 pm and becoming inactive at 6:00 am or 7:00 am, or the like). Light pack 30 may also be programmed to automatically make a telephone call to one or more telephone numbers upon detection of movement in the area under monitor. The operational software code may also cause the CPU to include the date, time of day, and location (e.g., street address or the like) of the lighting security system on the digital image or video recorded by the imaging unit. For example, if the imaging unit is a digital video camera the operational software code may cause the CPU to show the date, time of day, and location of the lighting security system on the bottom of the recorded video. The operational software code may also cause the CPU to automatically electronically transfer imaging data after recording in a wireless manner to a desired location, e.g., a desired internet address, a security company, or the like. RAM temporarily stores data.

Timer 126 (see FIG. 6) is configured to activate halogen lights 36 and/or an audible indicator after detection of a disturbance in the area under monitor for a predetermined amount of time and to deactivate light pack 30 after the predetermined amount of time ends. For example timer 126 may activate power lamps 36 and/or an audible indicator for one to five minutes or the like after detection of a disturbance in the area under monitor. Timer 126 may be any known timer in the art. Light pack 30 may include switch(es) 110 (see FIG. 6) to enable a user to easily perform a variety of functions, such as turning the light pack on or off, taking a picture, or the like.

Light pack 30 may include one or more modems 120 to transfer data to and from light pack 30 (see FIG. 6). Any known internal or external modem 120 may be employed. Communications between light pack 30 and an external device, such as a personal computer or the like, occur over a universal asynchronous receiver transmitter link. Modem 120 may be included in light pack 30 by inserting a modem card into a bus connector of light pack 30 for connecting to the light pack 30 directly (an internal modem) or a modem 120 may be connected to light pack 30 over a communication port, when the modem 120 is external. Internal and external modems have an onboard processor or controller for managing the data protocols and transfers. As described above, light pack 30 may include operational software code to automatically electronically transfer imaging data after recording in a non-wireless manner to a desired location, e.g., a desired internet address, a security company, or the like. In addition, light pack 30 may include operational software to enable an authorized user to remotely reprogram light pack 30 through a telephone line utilizing a security code, such as a personal identification number or the like.

Light pack 30 may also include any known type of audible indicator 116, such as bells, a siren, a horn, an alarm, or the like, the sound level being adjustable according to the desires of the user (see FIG. 6). Light pack 30 may be configured to activate such an audible indicator when disturbances occur in the area under monitor during times when the light pack is inactive, such as during daytime hours or the like. Light pack 30 is configured to transfer data non-wirelessly, so light pack 30 includes one or more modems and one or more RJ-11 jacks to permit interconnection of light pack 30 with a standard telephone line as well as an external computer.

Rechargeable battery pack 38 is continuously charged by external 120 VAC utility power. Light pack 30 includes a power cord with a connector to engage with an external utility power source. The use of rechargeable battery pack 38 prevents light pack 30 from being deactivated by cutting the power cord.

Figure 4:
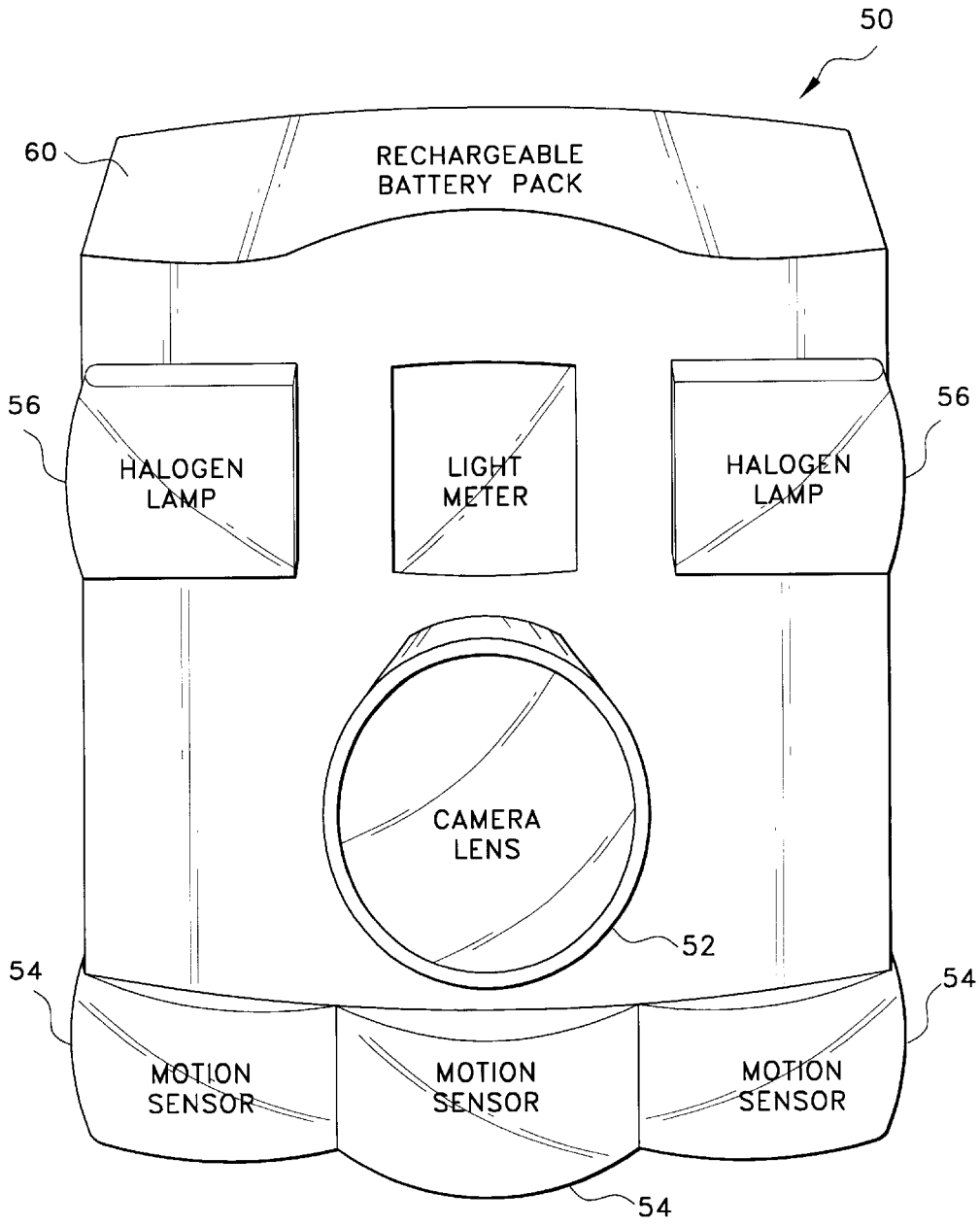
FIG. 4 is a front perspective view of an example of a camera/light source for a lighting security system according to the present invention.

FIG. 4 illustrates another example of a light pack 50 according to the invention. Light pack 50 is configured for use external to a business or residence. Light pack 50 includes two halogen lights 56, three motion sensors 54, an imaging unit (not shown), an electric eye (not shown), a lens 52, a processing element (not shown), a timer (not shown), and a rechargeable battery pack 60. Light pack 50 may also include one or more switches, an audible indicator, and a modem configured to wirelessly or non-wirelessly transfer data to/from the light pack. Light pack 50 is configured for wireless data transfer, so light pack 50 also includes a transceiver and an antenna.

Each halogen light 56 preferably has a wide angle light range, such as about 240° or the like, and may consume power in the range of about 300 to 700 watts, or the like. However, any known bright light source may be used according to the desires of the user.

Any known motion sensor 54 may by utilized in light pack 50. For example, each motion sensor 54 may be PIR motion sensor. Such sensors have about a 120° arc and about a 50 foot range detection zone. However, motion sensors 54 are known having a different arc or range detection zone, such as up to 500 feet. Known motion sensors 54 also include those based on reflections of electromagnetic waves, light waves, and ultrasonic pressure, those based on the disturbance of static electric or magnetic fields, and those based on any other phenomenon whereby the motion of something within an area can be detected. In this example, three motion sensors 54 are employed, however any number may be used. The sensitivity of motion sensors 54 may be adjusted in accordance with the desires of the user.

The imaging unit 108 (see FIG. 6) is preferably a digital camera that is configured to record digital image data in a data storage area. Such a camera includes an image sensor 114, such as a charge coupled device or the like, which converts photons into electrons, filters to provide color, and a removable recording device. Alternatively, imaging unit 108 may be a digital video camera that is configured to record digital video image data. The lens 52 for either a digital camera or a digital video camera is preferably a wide angle lens, such as 180° or more. The lens 52 may have adjustable iris, focus, and zoom. The operation of digital cameras and digital video cameras are well known in the art.

The electric eye 112 (see FIG. 6) may be a photosensitive element that activates a light source in response to receiving a predetermined amount of light from a light source of another light pack or an independent light source. Incorporation of an electric eye 112 into light pack 50 enables light pack 50 to be slaved to another light pack 50. For example, upon proper positioning and motion sensing, halogen lights 56 in one light pack 50 may become active. One halogen light 56 may be positioned for emitting light toward the area under monitor. The other halogen light 56 may emit light toward the electric eye 112 of another light pack 50. As such, a home equipped with a plurality of light packs 50 positioned about the perimeter of the home may all become active after a single light pack 50 becomes active. Alternatively, the halogen light 56 of one light pack 56 may emit light toward the area under monitor while the other halogen light 56 may emit light toward a particular window of the home or a neighbor's home, etc., according to the desires of the user.

The processing element may include a control 104 and memory 106 (see FIG. 6). Control 104 may be any known integrated control element, such as a central processing unit or the like. Memory 106 may include RAM, ROM, and a data storage memory. ROM stores operational software code that is read and processed by the CPU, and that causes the CPU to perform programmed functions such as activating the lens, the lights, etc. For example, light pack 50 may be programmed to be inactive during daytime hours and to become active during nighttime hours (such as becoming active at 9:00 pm or 10:00 pm and becoming inactive at 6:00 am or 7:00 am, or the like). Light pack 50 may also be programmed to automatically make a telephone call to one or more telephone numbers upon detection of movement in the area under monitor. The operational software code may also cause the CPU to include the date, time of day, and location (e.g., street address or the like) of the lighting security system on the digital image or video recorded by the imaging unit. For example, if the imaging unit is a digital video camera the operational software code may cause the CPU to show the date, time of day, and location of the lighting security system on the bottom of the recorded video. The operational software code may also cause the CPU to automatically electronically transfer imaging data after recording in a wireless manner to a desired location, e.g., a desired internet address, a security company, or the like. RAM temporarily stores data.

Timer 126 (see FIG. 6) is configured to activate the halogen lights 56 and/or an audible indicator after detection of a disturbance in the area under monitor for a predetermined amount of time and to deactivate the halogen lights 56 and/or audible indicator after the predetermined amount of time ends. For example timer 126 may activate power lamps 56 and/or an audible indicator for one to five minutes or the like after detection of a disturbance in the area under monitor. Timer 126 may be any known timer in the art. Light pack 50 may include switches to enable a user to easily perform a variety of functions, such as turning light pack 50 on or off, taking a picture, or the like.

Light pack 50 may include one or more modems 120 to transfer data to and from light pack 50 (see FIG. 6). Any known internal or external modem 120 may be employed. Communications between light pack 30 and an external device, such as a personal computer or the like, occur over a universal asynchronous receiver transmitter link. A modem 120 may be included in the light pack by inserting a modem card into a bus connector of light pack 50 for connecting to light pack 50 directly (an internal modem) or a modem 120 may be connected to light pack 50 over a communication port, when the modem 120 is external. Internal and external modems 120 have an onboard processor or controller for managing the data protocols and transfers. As described above, light pack 50 may include operational software code to automatically electronically transfer imaging data after recording in a wireless manner to a desired location, e.g., a desired internet address, a security company, or the like. In addition, light pack 50 may include operational software to enable an authorized user to remotely reprogram light pack 34 50 by a wireless telephone utilizing a security code, such as a personal identification number or the like.

Light pack 50 may also include any known type of audible indicator 116, such as bells, a siren, a horn, an alarm, or the like, the sound level being adjustable according to the desires of the user (see FIG. 6). Light pack 50 may be configured to activate such an audible indicator when disturbances occur in the area under monitor during times when the light pack is inactive, such as during daytime hours or the like. Light pack 50 is configured for wireless transfer of data, and includes a transceiver 122 and an antenna 124. Transceiver 122 may be any known transceiver including a transmitter and a receiver, which may be RF, microwave, or the like, configured to send and receive signals in the light packs described above. Transceiver 122 is also configured to receive and transmit wireless signals to transfer data to/from light pack 50. As described above, light pack 50 may include operational software code to automatically electronically transfer in a wireless manner imaging data after recording to a desired location, e.g., a desired internet address, a security company, or the like. Configuring light pack 50 for wireless transfer of data prevents light pack 50 from being disabled by cutting telephone lines that would be connected to light pack 50 if it were configured for non-wireless data transfer.

Rechargeable battery pack 60 is continuously charged by external 120 VAC utility power. Light pack 50 includes a power cord with a connector to engage with an external utility power source. The use of rechargeable battery pack 60 prevents light pack 50 from being deactivated by cutting the power cord.

Figure 5:
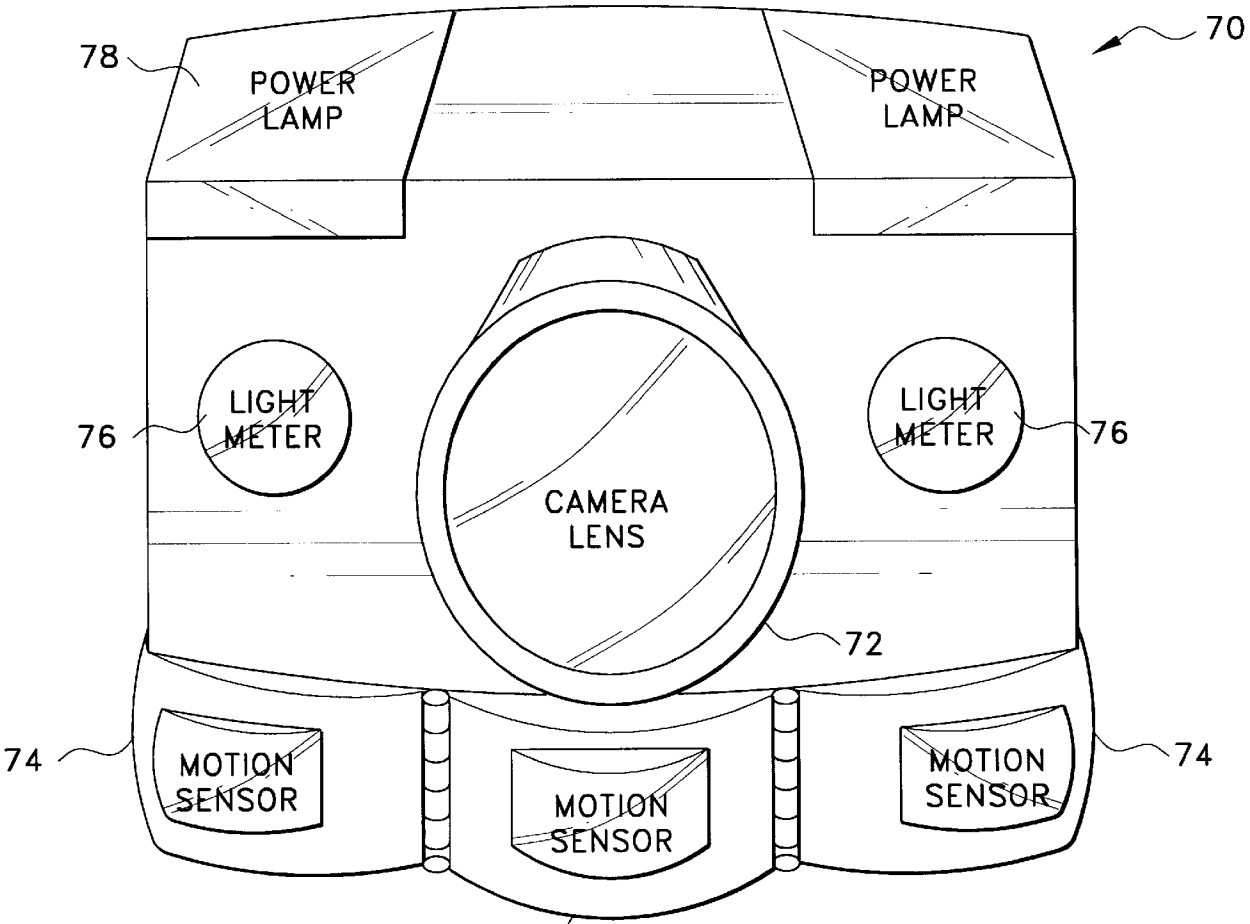
FIG. 5 is a front perspective view of a third example of a camera/light source for a lighting security system according to the invention.

FIG. 5 illustrates another example of a light pack 70 according to the invention. Light pack 70 is configured for use inside a business or residence. For example, light pack 70 may be placed in a child's bedroom. Light pack 70 includes two power lamps 78, three motion sensors 74, two light meters 76, an imaging unit (not shown), an electric eye (not shown), a lens 72, a processing element (not shown), a timer (not shown), and a power source (not shown). Light pack 70 may also include one or more switches, an audible indicator, and a modem configured to wirelessly or non-wirelessly transfer data to/from light pack 70. Light pack 70 is configured for non-wireless data transfer, so light pack 70 includes one or more modems and one or more RJ-11 jacks to permit interconnection of light pack 30 with a standard telephone line as well as an external computer.

Each power lamp 78 may have brightness according to the desires of the user, and may have a wide angle light range, such as about 240° or the like. Any known motion sensor 74 may by utilized in light pack 70. For example, each motion sensor 74 may be PIR motion sensor. Such sensors have about a 120° arc and about a 50 foot range detection zone. However, motion sensors are known having a different arc or range detection zone, such as up to 500 feet. Known motion sensors 74 also include those based on reflections of electromagnetic waves, light waves, and ultrasonic pressure, those based on the disturbance of static electric or magnetic fields, and those based on any other phenomenon whereby the motion of something within an area can be detected. In this example, three motion sensors are employed, however any number may be used. The sensitivity of the selected motion sensor 74 may be adjusted in accordance with the desires of the user.

The imaging unit 108 (see FIG. 6) is preferably a digital camera that is configured to record digital image data in a data storage area. Such a camera includes an image sensor, such as a charge coupled device or the like, which converts photons into electrons, filters to provide color, and a removable recording device. Alternatively, the imaging unit may be a digital video camera that is configured to record digital video image data in a data storage area. The lens 72 for either a digital camera or a digital video camera is preferably a wide angle lens, such as 180° or more. The lens may have adjustable iris, focus, and zoom. The operation of digital cameras and digital video cameras are well known in the art.

The electric eye may be a photosensitive element that activates a power lamp 78 response to receiving a predetermined amount of light from a power lamp 78 of another light pack 70 or an independent light source. Incorporation of an electric eye into light pack 70 enables light pack 70 to be slaved to another light pack 70. For example, upon proper positioning and motion sensing, the power lights 78 in one light pack 70 may become active. One power light 78 may be positioned for emitting light toward the area under monitor. The other power light 78 may emit light toward the electric eye of another light pack 70. As such, a home equipped with a plurality of light packs 70 positioned about the interior of the home may all become active after a single light pack becomes active. Alternatively, the power lamp 78 of one light pack 70 may emit light toward the area under monitor while the other power lamp 78 may emit light toward a mirror or a window of the particular room of the home, etc., according to the desires of the user.

The processing element may include a control 104 and memory 106 (see FIG. 6). Control 104 may be any known integrated control element, such as a central processing unit or the like. Memory 106 may include RAM, ROM, and a data storage memory. ROM stores operational software code that is read and processed by the CPU, and that causes the CPU to perform programmed functions such as activating the lens, the lights, etc. For example, light pack 70 may be programmed to be inactive during daytime hours and to become active during nighttime hours (such as becoming active at 9:00 pm or 10:00 pm and becoming inactive at 6:00 am or 7:00 am, or the like). Light pack 70 may also be programmed to automatically make a telephone call to one or more telephone numbers upon detection of movement in the area under monitor. The operational software code may also cause the CPU to include the date, time of day, and location (e.g., street address or the like) of the lighting security system on the digital image or video recorded by the imaging unit. For example, if the imaging unit is a digital video camera the operational software code may cause the CPU to show the date, time of day, and location of the lighting security system on the bottom of the recorded video. The operational software code may also cause the CPU to automatically electronically transfer imaging data after recording in a wireless manner to a desired location, e.g., a desired internet address, a security company, or the like. RAM temporarily stores data.

Timer 126 (see FIG. 6) is configured to activate power lamps 78 and/or an audible indicator after detection of a disturbance in the area under monitor for a predetermined amount of time and to deactivate the power lamps 78 and/or audible indicator after the predetermined amount of time ends. For example timer 126 may activate power lamps 78 and/or an audible indicator for one to five minutes or the like after detection of a disturbance in the area under monitor. Timer 126 may be any known timer in the art. Light pack 70 may include switches to enable a user to easily perform a variety of functions, such as turning light pack 70 on or off, taking a picture, or the like.

Light pack 70 may include one or more modems 120 to transfer data to and from light pack 70 (see FIG. 6). Any known internal or external modem 120 may be employed. Communications between light pack 70 and an external device, such as a personal computer or the like, occur over a universal asynchronous receiver transmitter link. A modem 120 may be included in light pack 70 by inserting a modem card into a bus connector of the light pack 70 for connecting to the light pack 70 directly (an internal modem) or a modem may be connected to the light pack 70 over a communication port, when the modem 120 is external. Internal and external modems 120 have an onboard processor or controller for managing the data protocols and transfers. As described above, light pack 70 may include operational software code to automatically electronically transfer imaging data after recording in a non-wireless manner to a desired location, e.g., a desired internet address, a security company, or the like. In addition, light pack 70 may include operational software to enable an authorized user to remotely reprogram light pack 70 non-wirelessly through a telephone line utilizing a security code, such as a personal identification number or the like.

Light pack 70 may also include any known type of audible indicator 116 (see FIG. 6), such as bells, a siren, a horn, an alarm, or the like, the sound level being adjustable according to the desires of the user. Light pack 70 may be configured to activate such an audible indicator when disturbances occur in the area under monitor during times when the light pack is inactive, such as during daytime hours or the like. Light pack 70 is configured to transfer data non-wirelessly, so light pack 70 includes an RJ-11 jack to permit interconnection of the light pack with a standard telephone line, and an RJ-11 jack to permit interconnection with an external computer, such as a personal computer (not shown).

The power source is preferably a rechargeable battery pack that is continuously charged by external 120 VAC utility power. Light pack 70 includes a power cord with a connector to engage with a utility wall jack in the room of the home. The use of a rechargeable battery pack prevents light pack 70 from being deactivated by cutting the power cord.

The lighting security system described above gives an interloper or intruder nowhere to hide and no time in which to operate 'unseen', by surrounding a premise to be guarded with lots of light. The ability of the lighting security system to be used inside a home will provide parents of children more of a sense of security in view of recent child abductions from within homes. With the lighting security system, detected disturbance in a secure location causes the lighting security system to spring to life in a ring of illumination all the way around the location's perimeter, not only in the area of breach but completely engulfing a secured home or business. The fantastic light display has a very powerful ability to intimidate and to warn. Criminals are attracted to a 'road of least resistance.' They also like to operate under the cover of darkness, yet the lighting security system is dramatic enough to warn an entire neighborhood that a breach of security is in effect. The home or business having an unsuspecting invader visit their property just once, will not only immediately discourage them, they'll never again return.

The great effect of just the lights is deterrence. The lights create a ring of illumination around a house or business. The lights face outward onto the property and may be seen from far off, possibly attracting the attention of passersby, neighbors, or the police. The home/location's own inhabitants are notified also, if desired, in a choice of different manners.

The lighting security system is not operated off of utility power, but off of rechargeable battery packs. The lighting security system, therefore, can not be affected by cut wires, power outages, power shortages, or briefly discontinued power service. The lighting security system is, however, connected to utility power which continuously recharges the batteries. If there is a power outage of any kind, the rechargeable batteries may be configured to last for a predetermined period of time, such as five days or the like, according to the desires of the user, after which they could be removed and charged at an alternate location until such time as local power is restored.

The imaging unit is configured to begin recording data immediately after the first flash of lights from the light packs. The imaging unit will include the date, time of day, and location of the home/business on the front of each recorded image. Copies of the recorded images may be taken from the light packs at times according to the desires of the use. Alternatively, as a safeguard against theft or damage, the recorded images may be downloaded to a specific address on the internet, where they may be sent or emailed immediately upon completion of recording.

Computer printouts may be retrieved and analyzed on a periodic basis or an on a per incident basis according to the desires of the user. The printout may include the printed time, date, and location of the particular lighting security system. The printout may also include any programming or security code changes, so that the individual who is authorized to set codes or change any of the system's programs, is informed of any unauthorized attempts to change the program, or of any changes made by anyone including themselves. Any printouts may be emailed wirelessly or non-wirelessly to any one or more internet addresses according to the desires of the user as a safeguard to their retrieval.

If one of the light sources of a light pack is disabled or damaged so that it is inoperable, all light sources of the particular lighting security system will instantly activate. If an individual attempts to remove any light pack of a particular lighting security system, the light sources of the particular light pack and the particular lighting security system will activate. The lighting security system may be operated wirelessly or non-wirelessly according to the desires of the user through the use of a security code or the like.

While the invention has been described with references to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

I claim:

1. A lighting security system comprising:

a plurality of light packs, each light pack comprising:

at least two light sources;

a plurality of motion sensors configured to monitor an associated designated area for movement of an object within the associated designated area;

an imaging unit;

an electric eye;

a lens;

a processing element;

a timer; and a power source, wherein each light of one light pack of the plurality of light packs becomes active in a predetermined direction upon detection of movement of an object in the designated area of the one light pack, one of the predetermined directions being toward another one of the plurality of light packs, and each light pack of the plurality of light packs successively activates until each light pack of the plurality of light packs is activated.

2. The lighting security system according to claim 1, wherein said light sources are halogen lights.

3. The lighting security system according to claim 2, wherein said halogen lights have a light range of at least 240°.

4. The lighting security system according to claim 2, wherein said halogen lights consume power in the range of 300 to 700 watts.

5. The lighting security system according to claim 1, wherein said motion sensors are passive infrared motion sensors.

6. The lighting security system according to claim 1, wherein said motion sensors are selected from the group consisting of motion sensors based on reflections of electromagnetic waves, light waves, and ultrasonic pressure, and those based on disturbances of static electric or magnetic fields.

7. The lighting security system according to claim 1, wherein said imaging unit is a digital camera.

8. The lighting security system according to claim 1, wherein said imaging unit is a digital video camera.

9. The lighting security system according to claim 1, wherein said lens has a range of at least 180°.

10. The lighting security system according to claim 9, wherein said lens has adjustable iris, focus, and zoom.

11. The lighting security system according to claim 1, wherein said processing unit includes a control and memory.

12. The A lighting security system according to claim 11, wherein said control is a central processing unit.

13. The lighting security system according to claim 11, wherein said memory comprises read only memory and random access memory.

14. The lighting security system according to claim 1, wherein said light pack further comprises at least one modem.

15. The lighting security system according to claim 14, wherein said at least one modem includes an internal modem.

16. The lighting security system according to claim 14, wherein said at least one modem includes an external modem.

17. The lighting security system according to claim 14, wherein said light pack further comprises a transceiver and an antenna.

18. The lighting security system according to claim 1, wherein said power source is a rechargeable battery pack.

19. A method of effecting lighting security, the method comprising:

providing a plurality of light packs, each light pack having at least two light sources, a plurality of motion sensors, an imaging unit, an electric eye, a lens, a processing element, a timer, and a power source;

positioning each light pack to monitor an associated designated area for movement of an object within the associated designated area;

monitoring each designated area with the corresponding associated light pack for movement of an object in the associated designated area;

activating each light of one light pack in a predetermined direction upon detection of movement of an object in the designated area of the one light pack, one of the predetermined directions being toward another one of the plurality of light packs;

successively activating each light of other light packs of the plurality of light packs until each light pack is activated; and recording at least one image of at least one designated area with at least one imaging unit of at least one light pack.

20. The method of effecting lighting security according to claim 19, wherein the providing step further comprises providing halogen lights as the light sources.

21. The method of effecting lighting security according to claim 20, wherein the providing step further comprises providing the halogen lights with a light range of at least 240°.

22. The method of effecting lighting security according to claim 20, wherein the providing step further comprises providing the halogen lights with power consumption in the range of 300 to 700 watts.

23. The method of effecting lighting security according to claim 19, wherein the providing step further comprises providing the motion sensors in the form of passive infrared motion sensors.

24. The method of effecting lighting security according to claim 19, wherein the providing step further comprises selecting the motion sensors from the group consisting of motion sensors based on reflections of electromagnetic waves, light waves, and ultrasonic pressure, and those based on disturbances of static electric or magnetic fields.

25. The method of effecting lighting security according to claim 19, wherein the providing step further comprises providing the imaging unit in the form of a digital camera.

26. The method of effecting lighting security according to claim 19, wherein the providing step further comprises providing the imaging unit in the form of a digital video camera.

27. The method of effecting lighting security according to claim 19, wherein the providing step further comprises providing the lens with a range of at least 180°.

28. The method of effecting lighting security according to claim 19, wherein the step of providing further comprises providing the lens with adjustable iris, focus, and zoom.

29. The method of effecting lighting security system according to claim 19, wherein the step of providing further comprises providing the processing unit with a control and memory.

30. The method of effecting lighting security according to claim 29, wherein the step of providing further comprises providing the control in the form of a central processing unit.

31. The method of effecting lighting security according to claim 29, wherein the step of providing further comprises providing the memory with read only memory and random access memory.

32. The method of effecting lighting security according to claim 19, wherein the step of providing further comprises providing the light pack with at least one modem.

33. The method of effecting lighting security according to claim 32, wherein the step of providing further comprises providing the at least one modem with an internal modem.

34. The method of effecting lighting security according to claim 32, wherein the step of providing further comprise providing the at least one modem with an external modem.

35. The method of effecting lighting security according to claim 32, wherein the step of providing further comprises providing each light pack with a transceiver and an antenna.

36. The method of effecting lighting security according to claim 19, wherein the step of providing further comprises providing the power source in the form of a rechargeable battery pack.

* * * * *